US006596169B1

(12) United States Patent
Rong et al.

(10) Patent No.: US 6,596,169 B1
(45) Date of Patent: Jul. 22, 2003

(54) CYCLONE

(75) Inventors: Rui Xuan Richard Rong, Mt. Ommaney (AU); Timothy John Napier-Munn, Bellbowrie (AU)

(73) Assignee: University of Queensland, Queensland (AU)

( * ) Notice: Subject to any disclaimer, the term of this patent is extended or adjusted under 35 U.S.C. 154(b) by 0 days.

(21) Appl. No.: 09/763,790

(22) PCT Filed: Aug. 27, 1999

(86) PCT No.: PCT/AU99/00693

§ 371 (c)(1),
(2), (4) Date: Jun. 15, 2001

(87) PCT Pub. No.: WO00/12219

PCT Pub. Date: Mar. 9, 2000

(30) Foreign Application Priority Data

Aug. 28, 1998 (AU) ..... PP5546

(51) Int. Cl.[7] ..... B04C 3/06; B04C 5/04; B04C 5/13; B04C 5/10

(52) U.S. Cl. ..... 210/512.1; 55/459.1; 209/719; 209/720; 209/721; 209/732; 209/733

(58) Field of Search ..... 210/512.1; 55/459.1; 209/715, 717, 719, 720, 721, 727, 732, 733

(56) References Cited

U.S. PATENT DOCUMENTS 2,975,896 A * 3/1961 Hirsch ..... 209/727
4,344,538 A 8/1982 Fujisawa et al.
5,094,674 A 3/1992 Schweiss et al.

FOREIGN PATENT DOCUMENTS

AU A 12635/97 8/1997
DE 29 42 099 A1 4/1981
DE 4344507 A1 6/1995

OTHER PUBLICATIONS

Dorr–Oliver Incorporated, The fr DorrClone, Bulletin No. 2503, 1955.*

Abstract of Japanese Patent Application No. 07097861, published Oct. 15, 1996 as publication No. 08266938 A.

Abstract of Japanese Patent Application No. 07114289, published Nov. 19, 1996 as publication No. 08299728 A.

Abstract of Soviet Union Patent Application No. 679171 dated Oct. 30, 1978 in SU Abstract Bulletin 46, on Dec. 15, 1981 (3pp, Dwg. Nos. 1, 2/4).

Abstract of Soviet Union Patent Application No. 930776 dated May 21, 1980 in SU Abstract Bulletin 41 on Mar. 30, 1982 (4pp, Dwg. No. 2/4).

* cited by examiner

*Primary Examiner*—David A. Reifsnyder
(74) *Attorney, Agent, or Firm*—Joseph T. Leone, Esq.; DeWitt Ross & Stevens S.C.

(57) ABSTRACT

Disclosed is dense medium cyclone for separating particles of varying sizes from within a fluid stream. The particles to be separated are entrained within the fluid stream. The fluid stream is then introduced into a cyclone that includes a body and a side wall comprising an upper wall portion and adjacent lower wall portion tapering inwardly in a direction away from the upper wall portion. The cyclone further includes a vortex finder projecting substantially axially into the interior space through the upper end of the body and terminating at an internal end positioned below an inlet, the vortex finder defining an overflow outlet which removes the remaining fluid and entrained particles from the cyclone. The vortex finder and the upper wall portion are configured to define a feed zone of decreasing cross sectional area from the inlet to the internal end of the vortex finder.

24 Claims, 9 Drawing Sheets

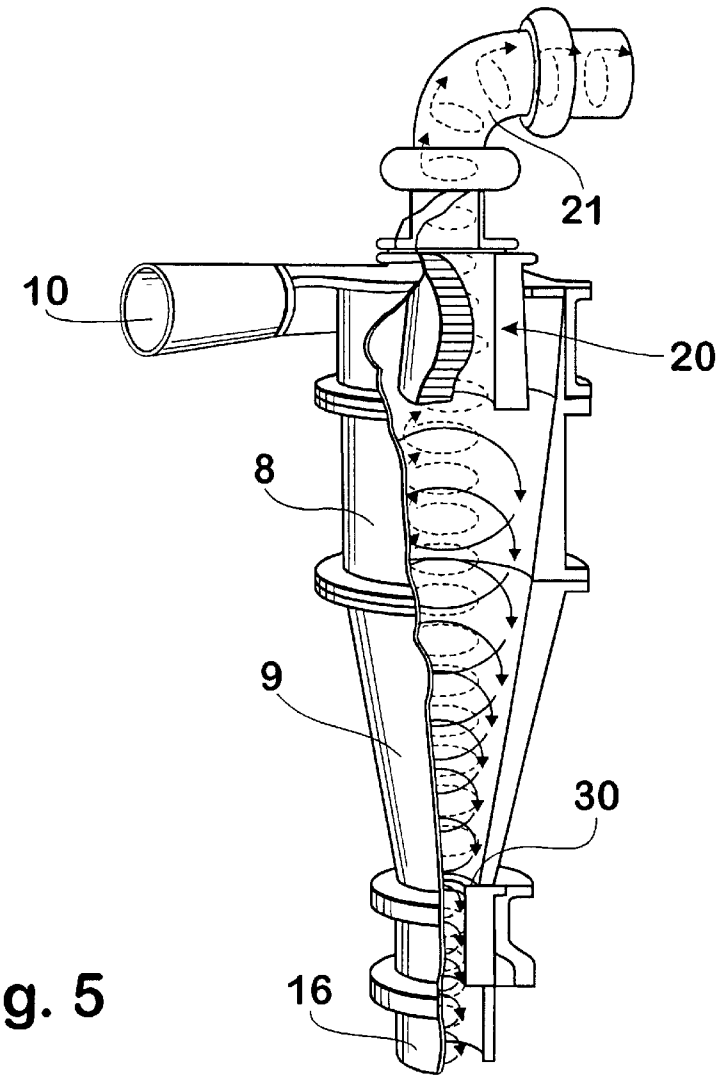
Fig. 5
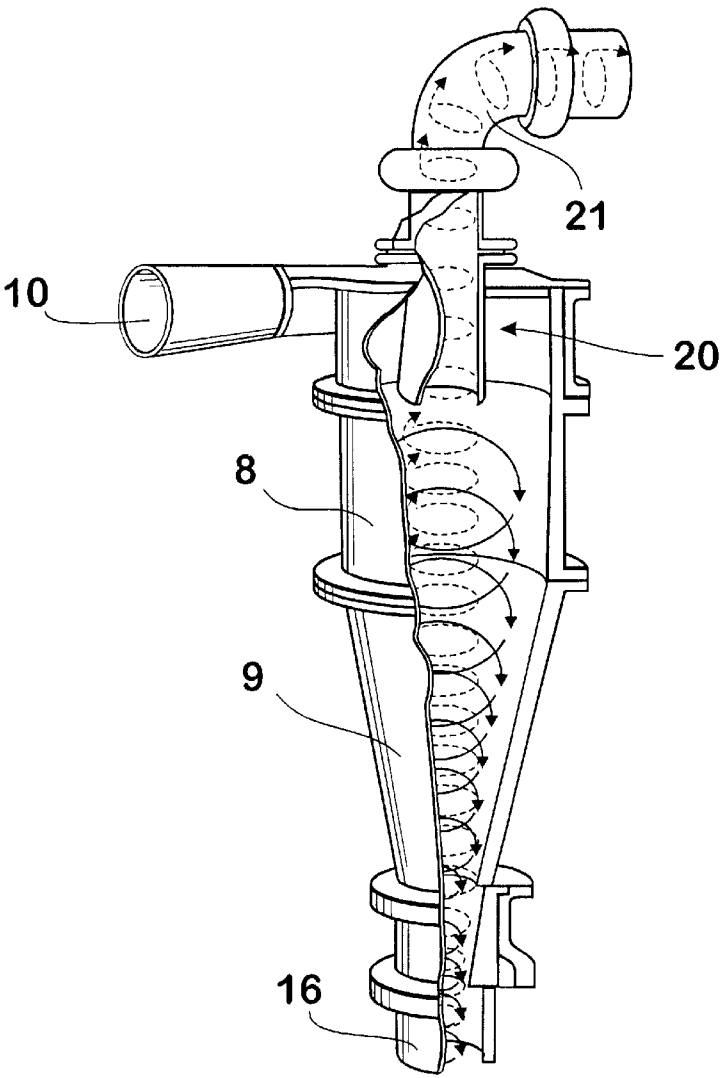

CYCLONE

This invention relates to a cyclone.

This invention relates particularly, but not exclusively, to dense medium cyclones for treating fine particles and classification cyclones and it will be convenient hereinafter to describe the invention with reference to these example applications. However, it is to be clearly understood that the invention is capable of application to other cyclones for example, water washing cyclones and dense medium cyclones for treating coarse particles.

In the specification the term "cyclone" is to be interpreted broadly and specifically to include hydrocyclones. Hydrocyclones which treat liquids containing entrained particles are thus a subset of the term "cyclones".

Broadly, a cyclone comprises a body defining an interior space having an upper cylindrical portion and a lower frusto conical portion. Fluid having entrained particles enters via a tangential or involute inlet towards the upper end of the body and passes out through an axial underflow outlet towards the bottom end of the body. Fluid and particles which do not pass out through the underflow outlet travel upwardly in an air core through a central region of the interior space of the cyclone and out through the overflow outlet. The overflow outlet is formed by a vortex finder which projects in through the top of the body of the cyclone into the interior space.

The shape of the body of the cyclone induces a helical spiral flow of fluid in the body in a radially outer region of the interior space. Then the flow changes direction and an air core spirals upwardly through a radially inner region of the interior space of the cyclone. The spiralling flow of fluid applies a centrifugal force to particles entrained within the fluid and exerts differing forces on the particles depending on their size and/or specific gravity. Heavier and/or larger particles are radially displaced towards the radially outer region of the interior space from where they pass out through the underflow outlet. Lighter and/or smaller particles tend to gravitate towards a radially inner region of the interior space and are carried upwardly with the air core which flows out through the overflow outlet. This thereby effects a separation of particles on the basis of specific gravity or size which is the key function of the apparatus.

Dense media cyclones are used for beneficiation of mineral ores, e.g. separation of heavy minerals or coal from unwanted gangue or tailings on the basis of difference in specific gravity. One application of dense media cyclones is to separate coal from non coal material in the ore which is mined out of the ground. In dense media cyclones, the relatively light coal particles are predominantly carried with the dense medium or liquid through the overflow outlet while the relatively heavier non coal particles are predominantly passed out through the underflow outlet. The efficiency of the cyclone is measured by its ability to provide a relatively sharp separation of coal and non coal particles, e.g. to reduce contamination of waste materials in the product and to reduce loss of valuable product with the waste materials.

A known prior art dense media cyclone is the cyclone illustrated in FIG. 1. This cyclone has a side wall comprising an upper wall portion of circular cylindrical configuration and a lower wall portion defining an interior space. One part of the lower wall portion has a frusto-conical configuration and the other part is in the form of a spigot projecting outwardly away from the end of the frusto-conical part. The cyclone has a vortex finder which has a relatively thin wall and does not occupy more than one third of the cross sectional area of the interior space of the body of the cyclone adjacent the inlet. Thus, the annular cross sectional area for fluid flow defined between the vortex finder and the upper wall portion is fairly large and the velocity of the fluid drops when it enters the cyclone. Another feature of the prior art dense media cyclone is that the internal junction between the frusto-conical part and the spigot part of the lower wall portion is smooth and without any interruption.

One limitation of these prior art cyclones is that there is a tendency for fluid to short circuit from the inlet to the overflow outlet without being subjected to the vigorous centrifugal forces developed in the interior space. There is also a tendency for fluid to short circuit along the side wall of the body or to be positioned in a boundary layer adjacent the side wall. Further there is a tendency for heavier particles to be entrained in an axial air core flowing up from the underflow outlet to the overflow outlet if the air core is too close to the side wall of the cyclone. The air core is very unstable. These occurrences detract from the efficiency of these cyclones.

Another limitation of the cyclone is its ability to separate out fine particles, eg 0.5 mm to 0.1 mm. This is because of the limited amount of centrifugal force generated in the cyclone. Currently, separation of very fine heavy minerals (2 mm to 0.1 mm) is undertaken using gravity concentrators, such as shaking tables, spirals and diaphragm jigs. However, the separation efficiency of this equipment is typically quite low. The concentrate from the separation often contains a considerable amount of waste material and a further separation, e.g. a downstream heavy liquids process, is often required.

Clearly therefore it would be advantageous if a dense media cyclone having increased efficiency and reduced contamination of waste material and product could be devised. It would also be advantageous if a dense media cyclone could be devised with an increased ability to separate out fine particles and thereby obviate the need for a separate step.

Classification cyclones are widely used in many industries for a variety of tasks in liquid-solid separation, including classifying, thickening, clarification, and desliming. Conventional classification cyclones have similar structural features to the dense media cyclone described above, but with different dimensions.

FIG. 2 is a schematic illustration of a conventional classification cyclone.

During operation of the cyclone, the spiralling flow and resultant centrifugal force, causes solids to be flung to the lower wall portion and spiral down to the underflow outlet. The bulk of the fluid e.g. liquid and very fine particles spiral upwards and leave the cyclone through the overflow outlet.

For any inlet pressure and rotational speed there is a theoretical "cut" size at which the centrifugal and drag forces are in balance. Theoretically, particles finer than the cut size are dragged with the bulk of the liquid through the vortex finder, and particles coarser than the cut size report to the underflow outlet.

Currently, the performance of conventional classification cyclones in industry is most unsatisfactory and contamination of particle sizes occurs in both the underflow and overflow material.

The reasons for this are varied and include the reasons articulated above in relation to the dense media separation cyclones. Some efforts have been directed towards the following areas in an effort to reduce these problems: change of feed parameters; modification of underflow and overflow outlets; introduction of additional components or formations to alter fluid-flow patterns; modification of the shape of the lower wall portion; and multi-stage cyclones. However, none have been commercially successful, mainly due to cost.

It would therefore be advantageous if a classification cyclone, e.g. a hydrocyclone, could be devised which at least partially overcame these problems.

According to one aspect of this invention there is provided a cyclone for effecting a separation on a fluid stream containing entrained particles, the cyclone including:

a body having a circumferential side wall extending between upper and lower ends and defining an interior space, the side wall comprising an upper wall portion and adjacent lower wall portion tapering inwardly in a direction away from the upper wall portion, the upper wall portion defining an inlet for introducing fluid and entrained particles into the interior space and the lower wall portion defining an underflow outlet extending in the direction of the longitudinal axis of the body for removing some fluid and entrained particles; and a vortex finder projecting substantially axially into the interior space through the upper end of the body and terminating at an internal end positioned below the inlet, the vortex finder defining an overflow outlet which removes the remaining fluid and entrained particles from the cyclone;

wherein the vortex finder and the upper wall portion are configured to define a feed zone within the interior space of decreasing cross sectional area, extending in a direction from the inlet to the internal end of the vortex finder.

The cyclone is suitable for use as both a dense media cyclone and a classification cyclone.

Preferably, the feed zone of decreasing cross-sectional area extends the full length from the inlet to the internal end of the vortex finder.

Preferably, the vortex finder includes an outer wall which diverges outwardly in a direction towards the internal end of the vortex finder, e.g. tapers outwardly towards the internal end of the vortex finder. The vortex finder may taper outwardly at an angle of 83° to 88° relative to an axis extending perpendicularly to the longitudinal axis of the body. For a dense medium cyclone, this angle is preferably 83°–87° and for a classification cyclone this angle is preferably 84°–88°.

The outer wall may diverge outwardly with a configuration other than a taper. For example, the outer wall may also be of undulating or stepped form.

Thus, by decreasing the cross sectional area of the feed zone in the annular space between the upper wall portion and the vortex finder, the velocity of the fluid and entrained particles entering the body is increased. This leads to increased centrifugal forces being applied to the particles driving the heavier or larger particles towards radial positions proximate to the side wall of the body and away from the vortex finder.

Further, by having the cross sectional area progressively decreasing in a direction away from the inlet, the fluid is accelerated and the centrifugal forces progressively increased thereby exerting a progressively increasing influence on the particles. This reduces the propensity of the heavier particles to short circuit directly to the overflow outlet.

In addition to assisting and increasing the centrifugal forces as described above, the outward taper on the vortex finder directs fluid entering the body through the inlet back towards the side wall which further reduces the likelihood of short circuiting flow to the overflow outlet.

The ratio of the diameter of the wall of the vortex finder at the internal end of the vortex finder to the diameter of the aligned upper wall portion of the body may be about 0.65 to about 0.85, e.g. 0.7 to 0.8.

The diameter of the outlet defined in the vortex finder may be less than one half of the diameter of the outer wall of the vortex finder at the internal end of the vortex finder.

Thus, by having the width of the vortex finder of substantially increased diameter relative to prior art cyclones, the cross sectional area for fluid flow is substantially decreased increasing the velocity of the fluid through this region of the interior space of the cyclone.

The thickness of the outer wall of the vortex finder may be 17%–23% of the diameter of the body of the cyclone at a position aligned with the internal end of the vortex finder, e.g. 17% to 20%.

Typically, the upper wall portion tapers inwardly in an axial direction away from the inlet, e.g. at an angle of 2° to 25° relative to the longitudinal axis of the body, preferably 3° to 20°, most preferably 3° to 10°.

Advantageously, the upper wall portion of a dense medium cyclone tapers inwardly at an angle of 8° to 10°. Advantageously, the upper wall portion of a classification cyclone tapers inwardly at an angle of 3° to 5°.

Typically, the lower wall portion tapers inwardly away from the upper wall portion at an angle of 2° to 12° relative to the longitudinal axis of the body, preferably 4° to 10°, most preferably 4° to 6°.

According to another aspect of this invention, there is provided a cyclone for effecting a separation on a fluid stream containing entrained particles, the cyclone including:

a body having a circumferential side wall extending between upper and lower ends and defining an interior space, the side wall comprising an upper wall portion and adjacent lower wall portion tapering inwardly in a direction away from the upper wall portion, the upper wall portion defining an inlet for introducing fluid and entrained particles into the interior space and the lower wall portion defining an underflow outlet extending in the direction of the longitudinal axis of the body for removing some fluid and entrained particles; and a vortex finder projecting substantially axially into the interior space through the upper end of the body and terminating at an internal end positioned below the inlet, the vortex finder defining an overflow outlet which removes the remaining fluid and entrained particles from the cyclone;

wherein the vortex finder occupies at least 40% of the cross sectional area of the body of the cyclone at a position aligned with the internal end of the cyclone.

Typically, the vortex finder occupies between 40% and 60 of the cross sectional area of the body of the cyclone at a position aligned with the internal end, more preferably between 40% and 55% of the cross sectional area.

According to yet another aspect of this invention, there is provided a cyclone for effecting a separation on a fluid stream containing entrained particles, the cyclone including:

a body having a circumferential side wall extending between upper and lower ends and defining an interior space, the side wall comprising an upper wall portion and adjacent lower wall portion tapering inwardly in a direction away from the upper wall portion, the upper wall portion defining an inlet for introducing fluid and entrained particles into the interior space and the lower wall portion defining an underflow outlet extending in the direction of the longitudinal axis of the body for removing some fluid and entrained particles; and a vortex finder projecting substantially axially into the interior space through the upper end of the body and terminating at an internal end positioned below the inlet, the vortex finder defining an overflow outlet which removes the remaining fluid and entrained particles from the cyclone;

wherein the lower wall portion defines a formation projecting inwardly into the interior space of the body.

Preferably, the formation is a shoulder extending substantially fully around the circumference of the lower wall portion, e.g. having a depth of 1 mm to 5 mm and/or 3%–6% of the diameter of the underflow outlet.

Typically, the lower wall portion forms a spigot adjacent the lower end of the body and the shoulder is formed proximate the spigot.

The shoulder has the effect of spacing the side wall of the body away from an air core or air plug which flows through the underflow outlet of the body and up through a central region of the interior space and out through the overflow outlet. By spacing the side wall away from the air core, the air core is less inclined to entrain heavier particles in a radially outer position and sweep them up and out through the overflow outlet.

In a cyclone of up to 100 mm diameter, the shoulder preferably has a depth of about 1 mm. The depth of the shoulder is dependent on the particle size to be separated and the underflow diameter.

The invention also extends to a cyclone having a body and a vortex finder, e.g. as described above, and wherein the outer wall of the vortex finder tapers outwardly towards the internal end of the vortex finder, e.g. at an angle of 83° to 88°, to an axis extending perpendicular to the longitudinal axis through the body of the cyclone.

A cyclone, particularly a dense medium cyclone, and a classification cyclone, in accordance with this invention may manifest itself in a variety of forms. It will be convenient hereinafter to describe in detail several preferred embodiments of the cyclones with reference to the accompanying drawings. The purpose of providing this description is to instruct persons interested in the subject matter of the invention how to carry the invention into practical effect. It is to clearly understood however that the specific nature of this description does not supersede the generality of the preceding broad description. In the drawings:

FIG. 5 is a schematic cutaway three dimensional view of, respectively, the cyclone of FIG. 1 and a dense media cyclone in accordance with the invention to provide an easy basis for visual comparison of the features of the respective cyclones;

The structural features of the prior art cyclones are discussed in the preamble of the specification. In addition, these cyclones will be well known to persons skilled in the art. Accordingly, they will not be described in any further detail in this specific description.

Figure 1:
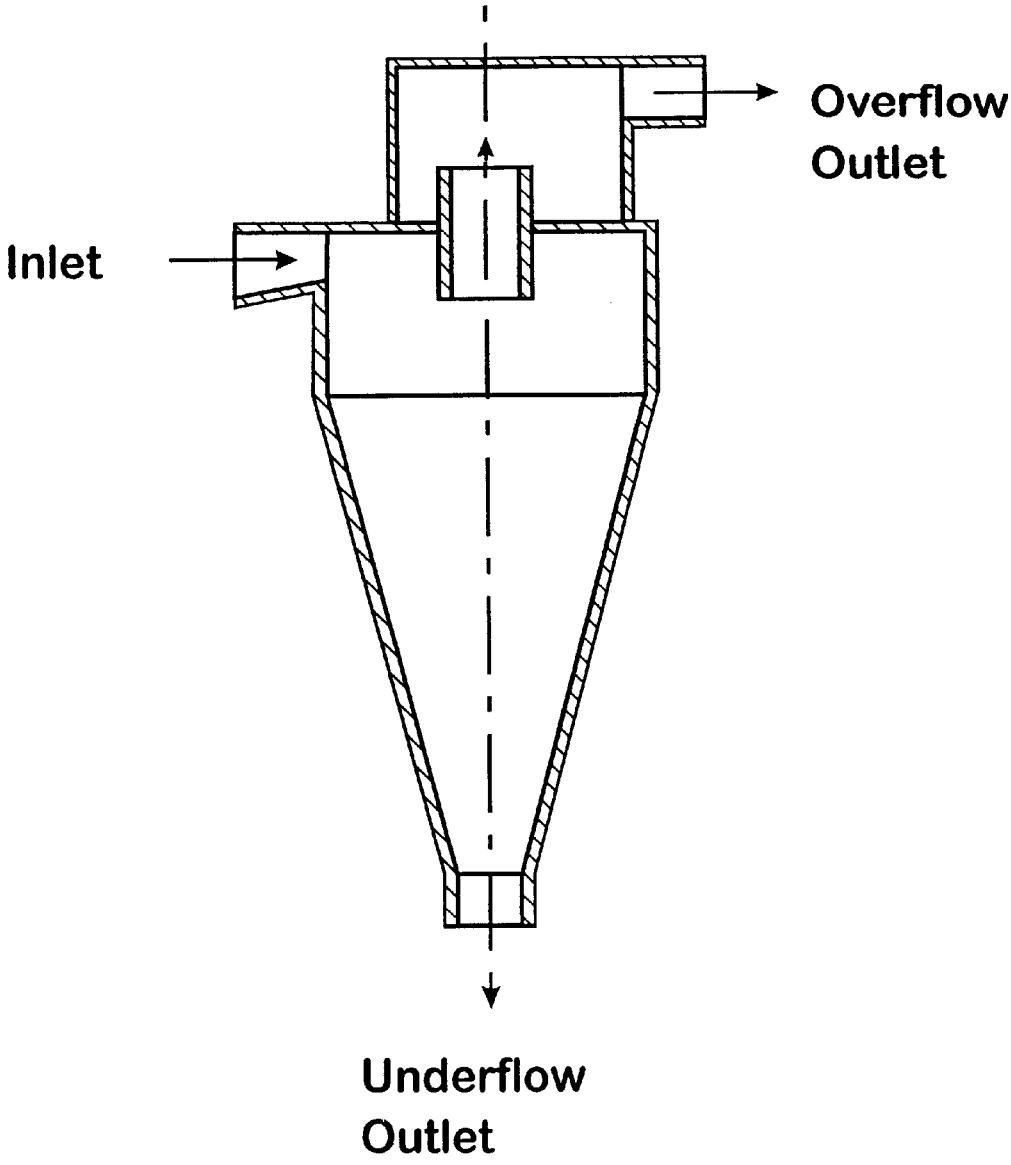
PRIOR ART Fig. 1
FIG. 1 is a schematic, cross sectional view of a DSM dense media cyclone which is known in the art.
Figure 2:
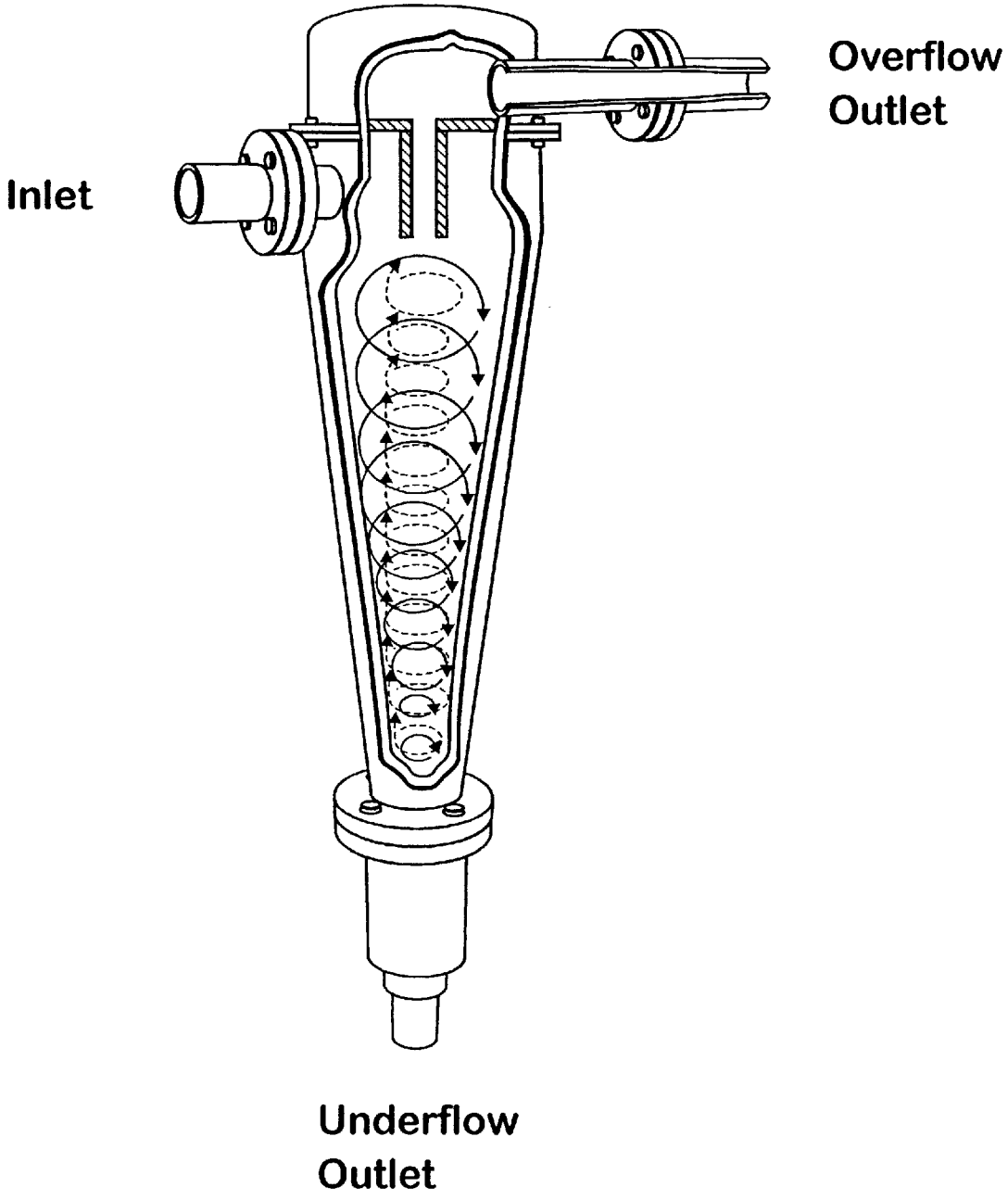
PRIOR ART Fig. 2
FIG. 2 is a schematic, cutaway three dimensional view of a classification cyclone which is known in the art.
Figure 3:
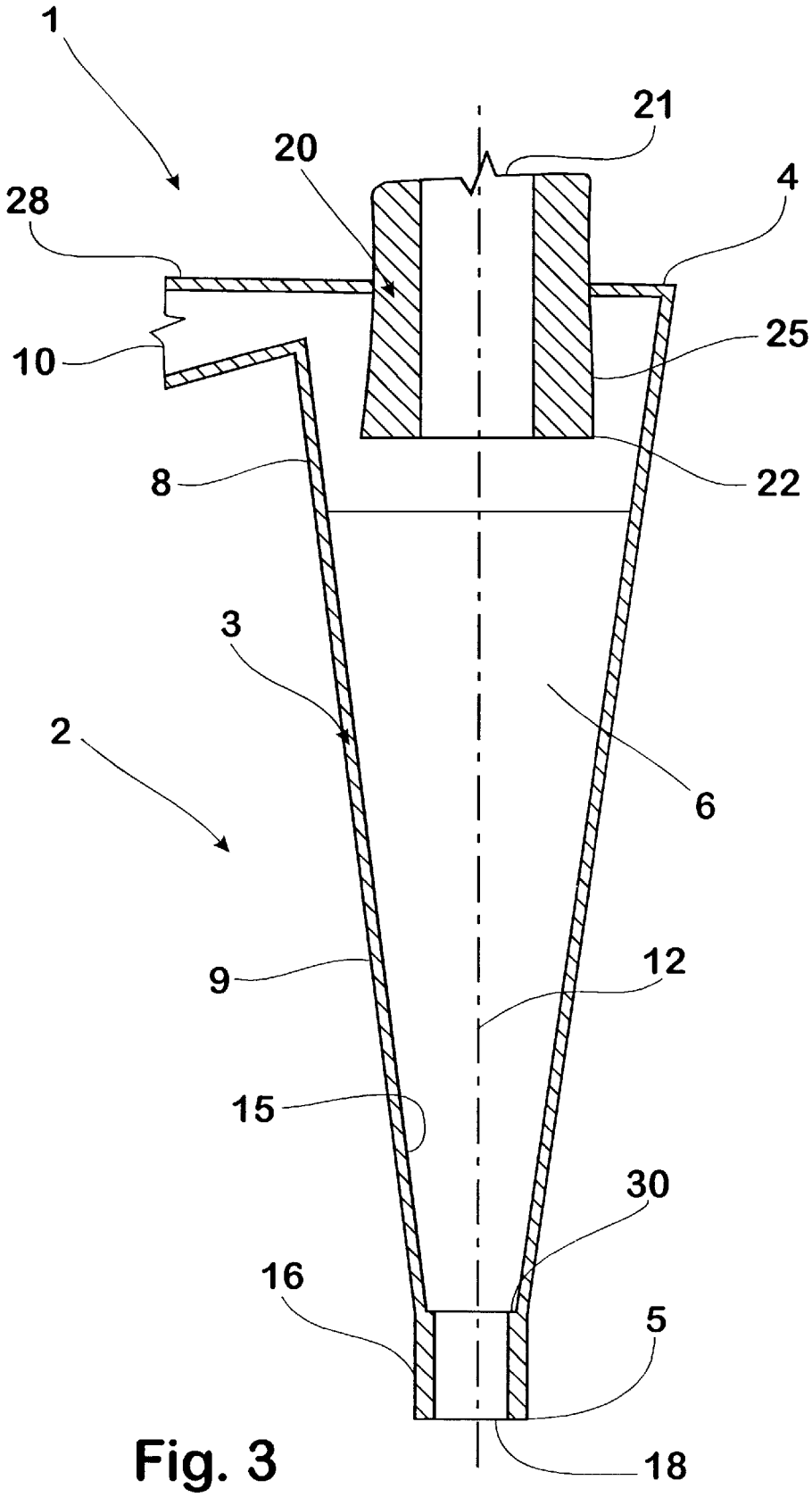
FIG. 3 is a schematic, cross sectional view of a first embodiment of a dense media cyclone in accordance with this invention.

FIG. 3 is the first drawing of a cyclone in accordance with the invention. In FIG. 3, reference numeral 1 refers generally to a dense media cyclone in accordance with the invention.

Broadly, the cyclone 1 comprises a body 2 having a circumferential side wall 3 extending between upper and lower ends 4 and 5 and defining an interior space 6. The side wall 3 in turn comprises an upper wall portion 8 and an adjacent lower wall portion 9. The upper wall portion 8 defines an inlet 10 extending involutely into the body substantially perpendicular to the longitudinal axis 12 of the body 2 for admitting a fluid stream into the interior space 6. The lower wall portion 9 which comprises a frusto-conical part 15 and a spigot part 16 defines an axially directed outlet 18 for removing fluid and entrained particles from the body 2.

A vortex finder 20 projects substantially axially through the upper end 4 into the interior space 6. The vortex finder 20 defines an overflow outlet 21 which removes fluid and entrained particles from the cyclone. The vortex finder 20 terminates with an internal end 22 which is positioned at least a minimum distance below the inlet 10 of the cyclone 1. The region of the interior space defined between the upper wall portion 8 and vortex finder 20 forms a feed zone.

The upper wall portion 8 tapers inwardly downwardly to the lower wall portion 9 at an angle of ($\beta$) typically 8° to 10°. $\beta$ and the other symbols used in this description are indicated on the cyclone illustration in FIG. 4. The vortex finder 20 has an outer wall 25 which tapers outwardly downwardly towards its internal end 22. The illustrated vortex finder 20 tapers outwardly at an angle ($\alpha$) of 83° to 87° relative to a horizontal axis, i.e. perpendicular to the longitudinal axis passing through the body 2.

The combination of inward taper of the wall portion 8 and the outward taper of the outer wall 25 of the vortex finder 20 creates a feed zone of decreasing cross sectional area from the inlet 10 down to the internal end 22 of the vortex finder 20. This has the effect of accelerating the fluid and entrained particles through this region and increasing centrifugal forces. Further, the outer wall 25 of the vortex finder 20 is spaced a reasonable distance radially outwardly of the overflow outlet 21 defined in the vortex finder 20. This also has the effect of decreasing the cross sectional area of the feed zone for fluid flow between the upper wall portion 8 and the outer wall 25 of the vortex finder 20.

An inlet conduit 28 tapers inwardly adjacent the inlet 10 as is shown in the drawings. Again, this has the effect of accelerating the fluid as it enters the body 2. The size and configuration of the inlet conduit 28 and associated inlet 10 would typically be determined by the application to which the cyclone is being put according to traditional design criteria.

The frusto-conical part 15 of the lower wall portion 9 typically has an angle ($\theta$) of 4° to 6° relative to the longitudinal axis. This is smaller than typical prior art dense media cyclones for fine particles. This taper is generally important in generating the appropriate helical fluid flow pattern through the body of the cyclone to effect the desired separation. The specified angle (θ) is particularly suitable for fine particles, i.e. less than 2 mm. The angle (θ) will be increased if the cyclone is used for coarse particle separation, e.g. 50 mm to 0.5 mm.

The diameter of the spigot part 16 of the lower wall portion 9 is determined by the application of normal cyclone design criteria.

An important feature associated with the spigot part 16 is a formation which is a shoulder 30 extending radially inwardly from the wall portion 9 around the circumference of the lower wall portion 9. Typically the shoulder 30 has a depth or width of 3%–6% of the underflow diameter. For most cyclone diameters envisaged by the applicant, this will be in the region of 1 mm–5 mm.

Applicant believes that the shoulder 30 may be subjected to high levels of wear and erosion. It may therefore be necessary to make it from a hard abrasion and wear resistant material.

In use, a fluid stream, e.g. a liquid, containing entrained particles enters via the inlet 10 under pressure and flows helically down the body 2 towards the underflow outlet 18. The acceleration of the fluid and entrained particles through the feed zone acts to reduce short circuiting flow direct to the overflow outlet 21.

The rapid swirling flow of the fluid has the effect of displacing relatively heavier particles towards radially outer positions in the interior space proximate to the wall of the cyclone. Relatively lighter particles are displaced to a radially inner position in the interior space. As a result, the heavier particles tend to exit the cyclone via the underflow outlet 18.

A rapidly swirling core of air moves upwardly from the underflow outlet 18 through a central region of the interior space towards the vortex finder 20 where it exits via the overflow outlet 21. This swirling core of air which is very unstable carries with it the relatively lighter particles. The shoulder 30 on the lower wall portion 19 has the effect of spacing the relatively heavier particles in the radially outer positions away from the unstable air core moving from the underflow outlet 18 to the overflow outlet 21. This reduces entrainment of the heavier particles in this air core and loss to the overflow outlet 21.

The medium used for the dense media cyclone 1 depends on the actual mineral separation being effected within the cyclone 1. For the treatment of fine coal, ultrafine magnetite is typically used, e.g. having 95%–99% below 53 micron. For heavy mineral separation, e.g. iron ore separation an atomised ferrosilicon (Cyclone 60 supplied by Samancor) is used, which contains 92% below 38 micron.

Typically the cyclones have a diameter in the range of 100 mm–1200 mm. By the term "cyclone diameter" is meant the diameter of the body at the upper end of the upper wall portion. Experimental and pilot plant cyclones typically have a diameter of 100 mm–200 mm. Typically, commercial cyclones have a diameter in the range of 400 mm–750 mm.

FIG. 5 is a comparative illustration of the applicant's dense medium cyclone on the left and a prior art dense media cyclone shown on the right.

Figure 4:
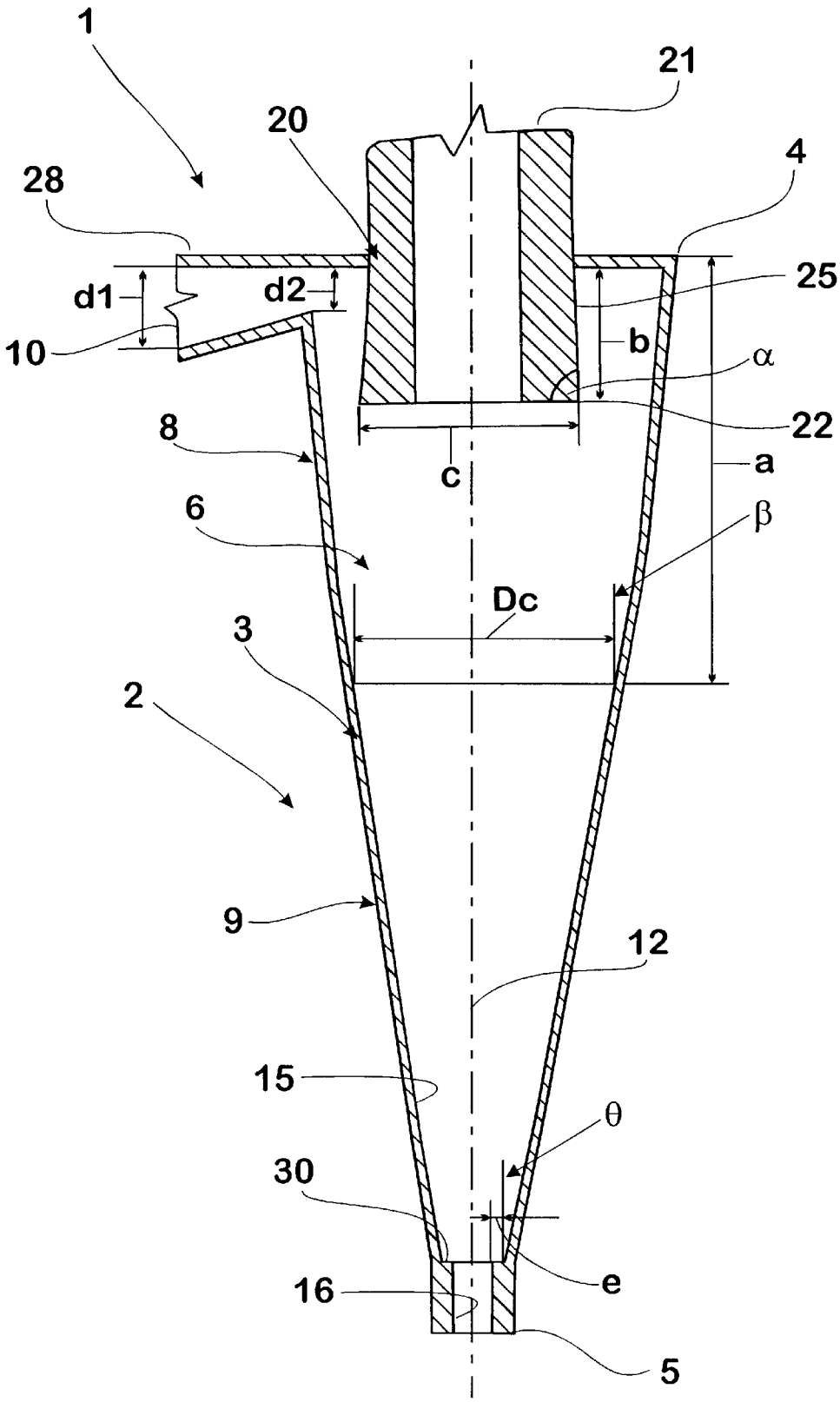
FIG. 4 is a schematic, cross sectional view of a second embodiment of a classification cyclone in accordance with the invention.

FIG. 4 refers to a classification cyclone in accordance with this invention. The classification cyclone illustrated in FIG. 4 is structurally and functionally very similar to the dense media cyclone illustrated and described with reference to FIG. 3. Accordingly, unless otherwise indicated, the same reference numerals will be used to refer to the same components.

The principle differences between the classification cyclone and the dense media cyclone are the length (a) and angle (β) of the upper wall portion relative to the longitudinal axis. The length (a) is noticeably longer in the FIG. 4 classification cyclone. The angle (β) in the classification cyclone is 3°–5° relative to the longitudinal axis which is less than in FIG. 3.

The shoulder 30 in the FIG. 4 cyclone is very similar to that in the FIG. 3 cyclone and the spacing of the internal end 22 of the vortex finder 20 below the inlet 10 is similar to that in the dense media cyclone of FIG. 3.

FIG. 4 also indicates several important cyclone parameters. These parameters are explained more clearly below:

| | |
|---|---|
| $D_c$ | cyclone diameter |
| a | vertical length of the upper part |
| b | vertical length of the internal portion of the vortex finder |
| c | diameter of the internal end of the vortex finder |
| d1 | internal diameter of an inlet of the feed conduit |
| d2 | equivalent diameter of an outlet of the feed conduit |
| e | a width of the shoulder |
| α | an included angle defined by an outer surface of the vortex finder at the internal end of the vortex finder and a horizontal plane |
| β | an included angle defined between a vertical axis and the upper wall portion |
| θ | an included angle defined between a vertical axis and the lower wall portion |

Some typical design parameters for a dense medium cyclone are discussed above. Other parameters include:

| | |
|---|---|
| b/a | 0.6 to 0.75 |
| b/c | 0.5 to 0.70 |
| $d_1/d_2$ | 1.5 to 1.75 |
| e/underflow diameter | 0.03 to 0.06 |
| overflow d/underflow d | 1.1 to 1.3 |

Some typical design parameters for classification cyclones are discussed above. Other parameters include:

| | |
|---|---|
| b/a | 0.25 to 0.35 |
| b/c | 0.95 to 1.20 |
| $d_1/d_2$ | 2.1 to 2.4 |
| e/underflow diameter | 0.04 to 0.05 |
| overflow d/underflow d | 1.45 to 1.65 |

COMPARATIVE TESTS

The performance of each of the dense media cyclone and classification cyclone was tested against industry standard prior art apparatus. These comparative tests are discussed in detail below.

DENSE MEDIA CYCLONE

In these comparative tests, a DSM (Dutch State Mine) cyclone was tested against the applicant's dense media cyclone (JKC).

Figure 6:
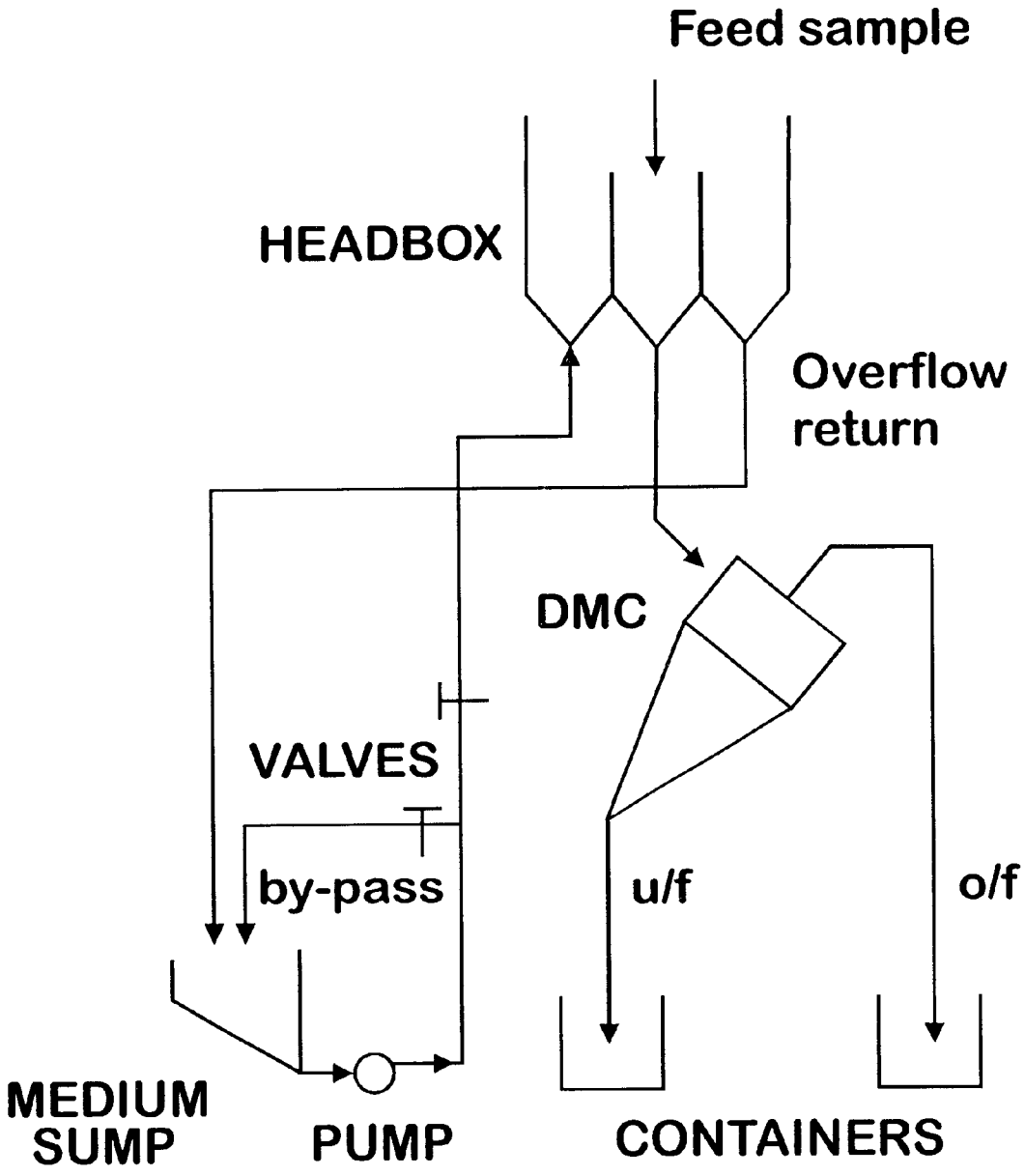
FIG. 6 is a schematic flowsheet of a test rig used to test the performance of the dense media cyclone of FIG. 3.

A test rig was assembled to conduct the test as illustrated in FIG. 6. Broadly the test rig comprised a medium sump, a pump and a head box. A test cyclone of 100 mm diameter was fixed on the rig with adjustable position and angle configuration. The cyclone was mounted at 20° to the horizontal plane. A dense medium was pumped into the head box and then allowed to flow by gravity into the cyclone. The feed pressure to the cyclone was in the range of 1 to 1.5 meters which is 10 to 15 times the cyclone diameter. The overflow and underflow of the cyclone were returned to the sump for recycling. Separation products were collected in containers through hoses.

The feed materials used in the test were 1 mm to 0.125 mm density tracers and fine coal particles. The tracer densities were in the range of 1.3 to 2.2 g/cm$^3$ varying in increments of 0.1 g/cm$^3$.

After the test runs had been conducted, partition numbers were calculated according to techniques well known in the art and a curve was fitted to the modified Whiten equation.

$$PNi = \frac{1}{\left[1 + \exp\left(\frac{1.0986(\rho 50 - \rho i)}{Ep}\right)\right]}$$

where p50—the cut point

ρi=the ith density direction

Ep—the ecarte probable

The partition number (or coefficient) is basically an empirical measure of the average probability of the particles in the respective density fraction reporting to one or other of the products, e.g. to the cyclone underflow. The partition curve describes the partition number as a function of the particle densities. The partition number was calculated for each density fraction by analysis of the raw feed and product sample.

The efficiency of separation for a dense medium cyclone is usually represented by the Ep value, which is calculated as follows:

$$Ep=(D_{75}-D_{25})/2$$

Where $D_{75}$ is the density at which the probability of reporting to the underflow is 75%, and $D_{25}$ is the density at which the probability of reporting to the underflow is 25%.

Figure 7:
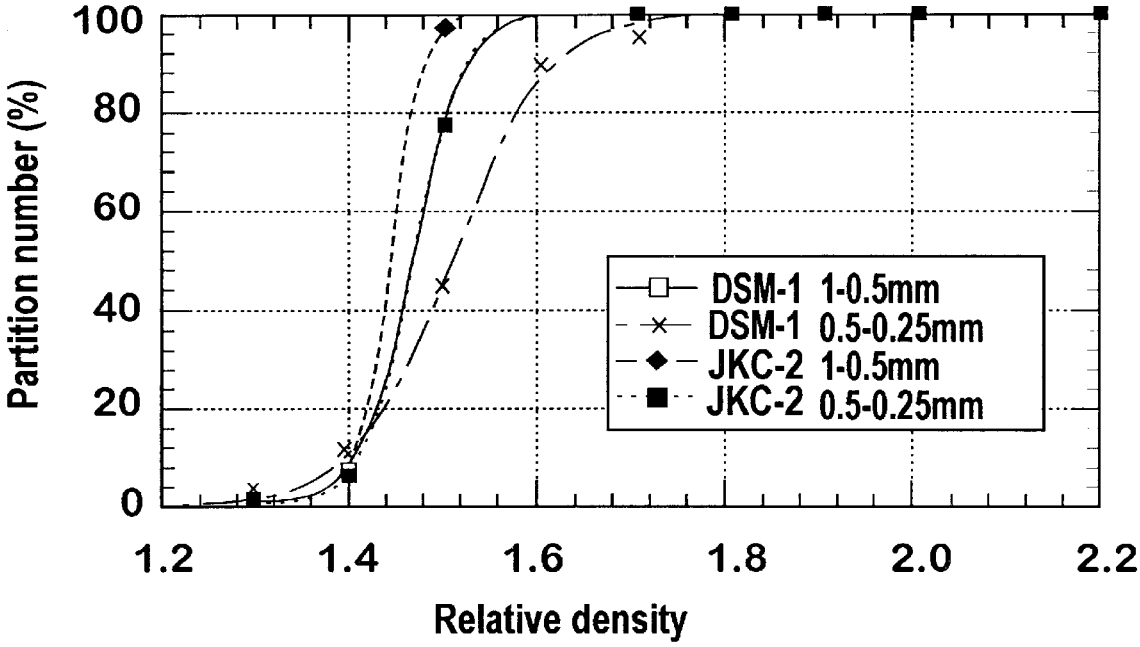
FIG. 7 is a graph of the comparative performance of a prior art (DSM) cyclone shown in FIG. 1 and the applicant's cyclone (JKC) shown in FIG. 3.
Figure 8:
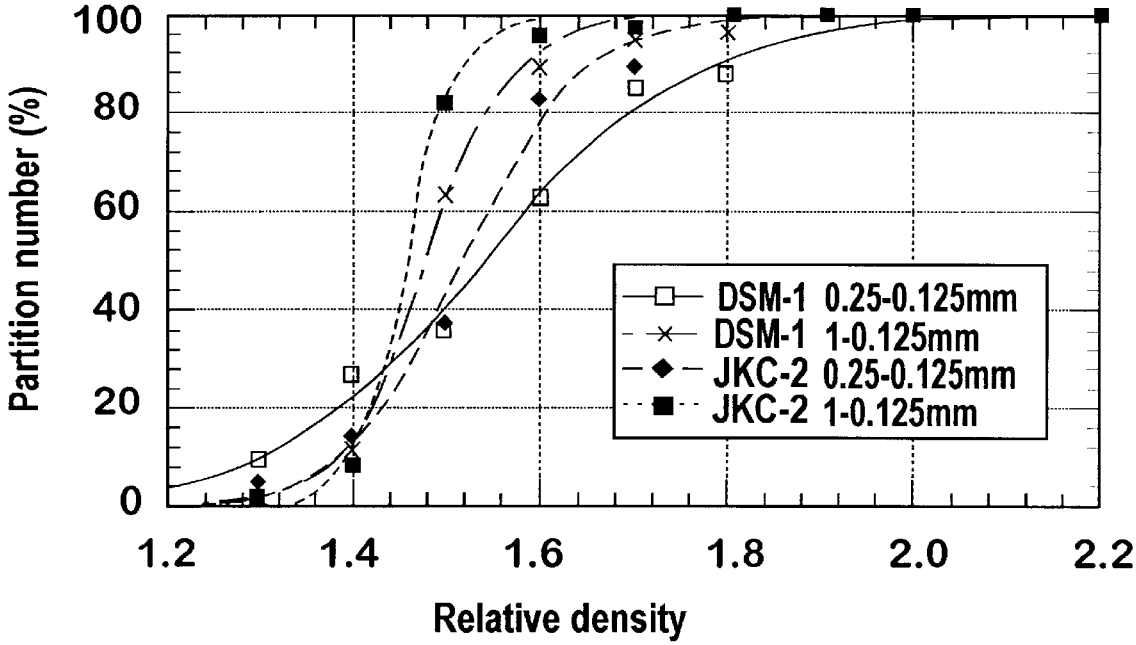
FIG. 8 is another graph of the comparative performance of the FIG. 1 and FIG. 3 cyclones.

The steeper the partition curve (or the smaller the Ep value), the better the separation. The partition curves are shown in FIGS. 7 and 8.

The Ep (ecarte probable) and the ρ50 (cut point) were calculated and typical test results are provided in the table below.

| | 1–0.5 mm | 0.5–0.25 mm | 0.25–0125 mm | 1 mm–0.125 mm |
|---|---|---|---|---|
| | | Performance of DSM Cyclone Ep (RD) | | |
| DSM-1 | 0.029 | 0.055 | 0.120 | 0.050 |
| | | ρ50 (RD) | | |
| DSM-1 | 1.468 | 1.507 | 1.540 | 1.479 |
| | | Performance of JKC Cyclone Ep (RD) | | |
| JKC-2 | 0.018 | 0.028 | 0.067 | 0.028 |
| | | ρ50 (RD) | | |
| JKC-2 | 1.443 | 1.470 | 1.523 | 1.461 |

The tests clearly demonstrate that the applicant's cyclone (JKC) delivers superior performance to the DSM cyclone. It produced a lower Ep and therefore a higher efficiency over all size ranges. The increase in efficiency was particularly pronounced for very fine particles (0.5 mm to 0.125 mm). The larger density difference between overflow and underflow for the JKC indicates that higher centrifugal forces are being generated inside the cyclone.

Further experimental work was done with a dense medium cyclone to separate diamond indicator material from a sample of almandine.

The cyclone had a diameter of 50 mm, an inlet diameter of 15 mm, an overflow diameter of 18 mm, and an underflow diameter of 16 mm. The upper wall portion had an angle β of 20° and the lower wall portion had an angle of 10° over a total length of 300 mm.

A feed of cyclone 60 ferrosilicon sized at 1 mm–0.18 mm was fed through the cyclone at a feed rate of 50–60 kg/hour and at a feed head of 1.5 m. The flow rate of the feed was 1.35 m$^3$/hour and the medium had a density of 2.6 g/cm$^3$. The underflow and overflow samples were analyzed by TPE (bromoform) and methylene iodide respectively after separation. The heavy almandine recovery and underflow was approximately 98% and the light materials less than 2.95 g/cm$^3$ reporting to the underflow was around 10%.

CLASSIFICATION CYCLONE

Comparative tests were also conducted to evaluate the performance of the applicant's classification cyclone (JKCC) and measure it against two well known industry cyclones, the Krebs cyclone and the Warman cyclone.

Figure 9:
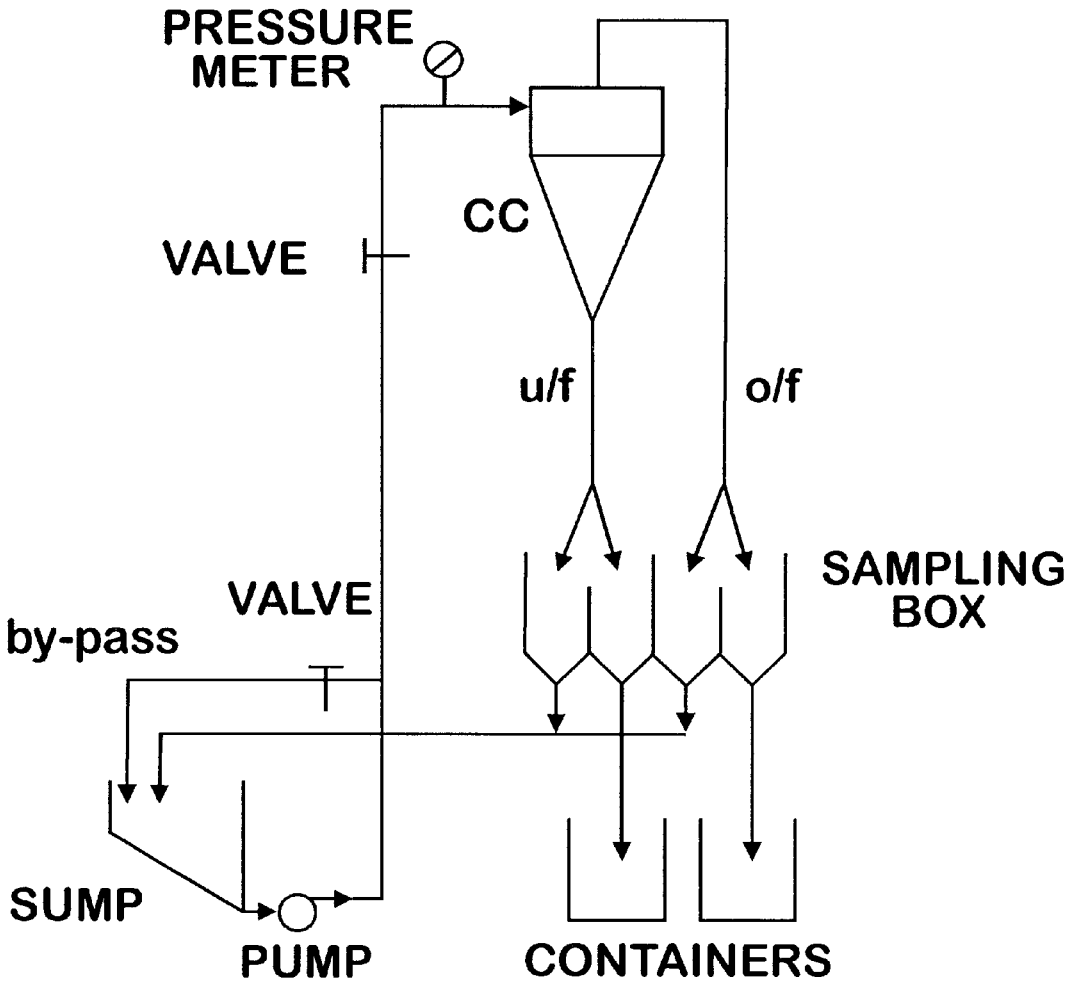
FIG. 9 is a schematic flowsheet of a test rig for testing the performance of the classification cyclone of FIG. 4 on fine coal against the performance of other prior art classification cyclones.

The test rig used for conducting comparative tests is illustrated in FIG. 9. Broadly, it comprised a sump, a pump, and a sampling box. The classification cyclones were each 100 mm in diameter and were vertically mounted. The feed was pumped into the classification cyclone at a predetermined pressure and the overflow and underflow gravitated into a sampling box.

The feed sample (less than 1 mm) used for the comparative tests was primary classification cyclone feed coal from a coal preparation plant in central Queensland.

The comparative tests were conducted for a variety of feed pressures, spigot diameter and vortex finder dimensions. The fraction of each size range reporting to the underflow was determined and plotted as a function of particle size. These parameters were set such that the results provided below serve as a fair indicator of comparative cyclone performance.

Actual cyclone efficiency (Ea) reporting to the underflow for each size fraction was calculated conventionally based on the size fraction and flowrate of the three streams.

It is generally known that the actual efficiency curve of a cyclone does not pass through the origin due to particle separation under a centrifugal force. To be independent of the centrifugal force acting on the particles, a corrected efficiency (Ec) is calculated using the formula $$Ec = \frac{Ea - Rf}{100 - Rf} * 100$$

where Rf is the fraction of the feed flow reporting to the cyclone underflow.

The correct efficiency curve is further translated into a reduced efficiency (Er) curve by plotting the correct efficiency values against the ratio of the particle size to the corrected separation size. The reduced efficiency curve can be expressed by the Lynch equation:

$$Er = \frac{\exp(\alpha di / d50c) - 1}{\exp(\alpha di / d50c) + \exp(\alpha) - 2}$$

$\alpha$ is the parameter describing the shape of the curve, di the particle size, and $d50_c$ is the corrected separation size.

The Lynch equation, its derivation and its use to measure cyclone performance would be well known to persons skilled in the cyclone art and accordingly, it will not be described in further detail in the specification.

The test results showing the parameters for the three cyclones are provided in the table below:

| | Rf | α | d50c |
|---|---|---|---|
| Krebs 4 | 35.1 | 4.286 | 0.047 |
| Krebs 5 | 29.8 | 3.734 | 0.044 |
| Warman 4 | 26.1 | 4.429 | 0.048 |
| Warman 5 | 25.1 | 3.698 | 0.044 |
| JKCC 13 | 25.2 | 8.106 | 0.045 |
| JKCC 17 | 28.1 | 15.793 | 0.050 |

In essence, the larger the a value the sharper the separation and the more effective the classification cyclone.

From the tabulated results above, it is clear that the applicant's classification cyclone (JKCC) achieves much better separation performance than other prior art classification cyclones. Further, for the same feed pressure, the separation size in the applicant's cyclone can be lower than for other cyclones due to a larger centrifugal force inside the applicant's cyclone. The applicant's cyclone thus has the ability to accomplish a lower separation size than the Krebs and Warman cyclones.

Figure 10:
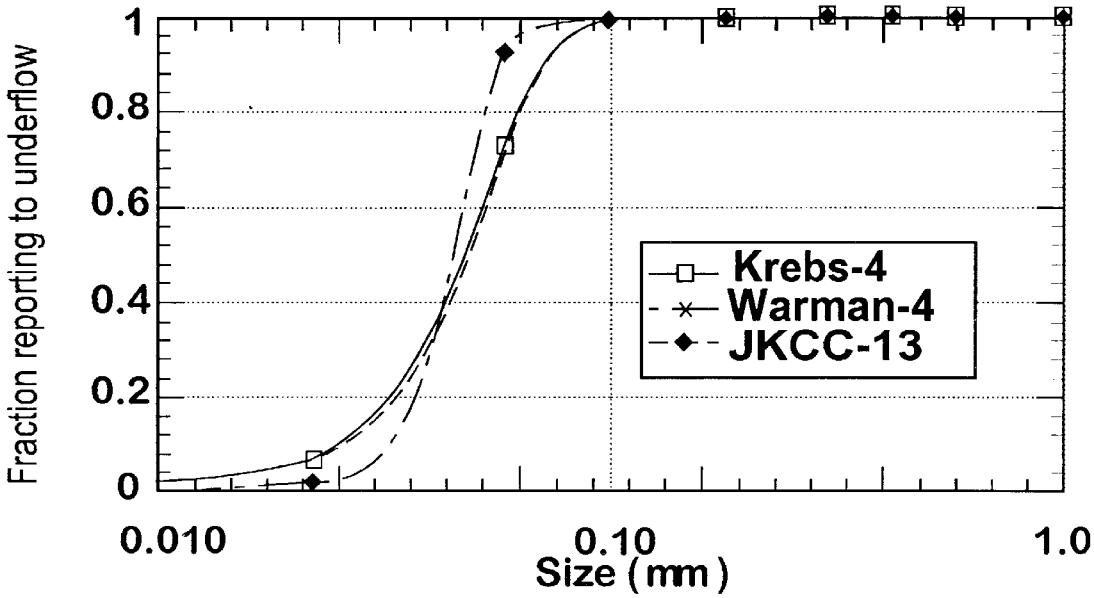
FIG. 10 is a graph of the comparative performance of prior art cyclones and the applicant's cyclone (JKCC) shown in FIG. 4.
Figure 11:
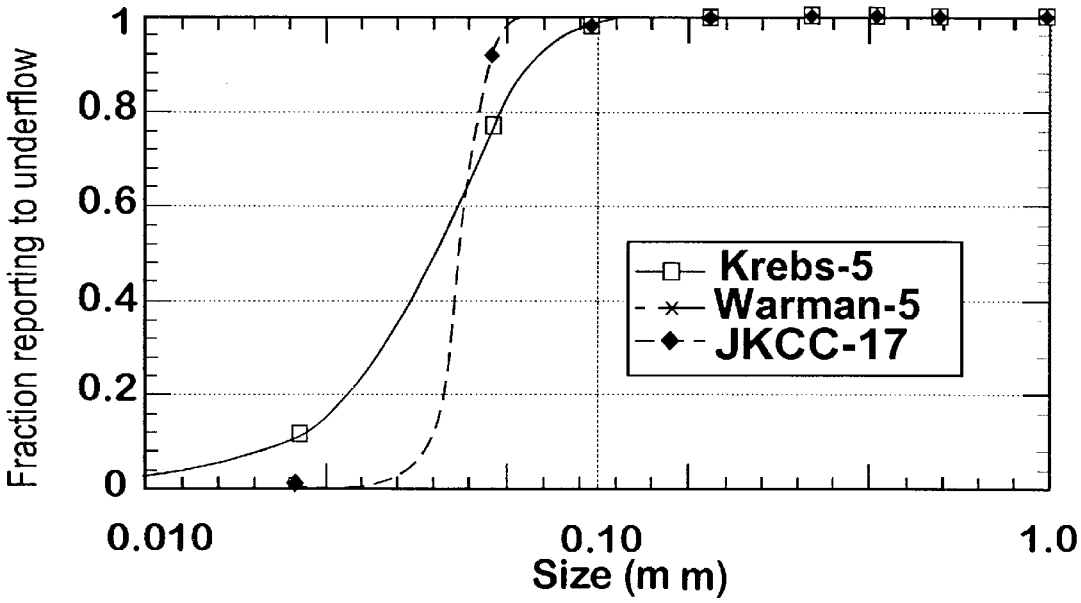
FIG. 11 is another graph of the comparative performance of respectively prior art classification cyclones and the applicant's classification cyclone.

Reduced efficiency curves plotting fraction reporting to underflow against size fraction are illustrated in FIGS. 10 and 11. The graphs clearly show the sharper separation achieved with the applicant's cyclones in the form of a steeper graph.

The different a values obtained for the different tests with the applicant's cyclone are due to differences in cyclone parameter, e.g. vortex finder diameter, spigot diameter, upper wall portion geometry and feed pressure. Typically, the feed pressure for these tests varied from 80 kPa to 100 kPa.

Applicant strongly submits therefore that its classification and dense media eparation cyclones described above have significantly improved fine particle separation over what was previously obtainable with industry standard equipment. Without being bound by theory, applicant believes that this is due to the increased centrifugal force within the cyclone and a reduction in short circuiting flow directly from the inlet to the overflow outlet. Further, applicant believes that its cyclone has substantially reduced entrainment of heavier and larger particles in the upwardly moving air core.

In a conventional known cyclone, the upper wall portion is cylindrical, and the area between the vortex finder and the cylinder wall acts to provide a preliminary separation. However, the true separation occurs in the conical section of the lower part of the cyclone. In the applicant's illustrated cyclone, the area between the vortex finder and the cyclone body is also conical in shape. This causes the upper wall portion of the new cyclone to assist in particle separation. The increased centrifugal force and a longer separation path and time inside the cyclone are believed to be one of major reasons higher separation efficiency is achieved.

The wall of the vortex finder of a conventional known cyclone is usually very thin, and the area between the vortex finder and the cyclone body is much larger than the area of the feed inlet. The flow velocity therefore decreases after entering the cyclone. In the applicant's illustrated cyclone, the wall of the vortex finder is thickened, reducing the area between the vortex finder and the cyclone body. As a result, the flow velocity and the centrifugal forces in the cyclone are much larger than those of conventional cyclones. The thick wall of the vortex finder also resists short-circuiting flow and increases the tangential velocity gradient.

The outer wall of the vortex finder is downwardly and outwardly tapered such that it guides the feed materials into the main helical flows for separation thereby further resisting short-circuiting flow.

Separation of very fine heavy minerals (2–0.1 mm) is currently undertaken using gravity concentrators, such as shaking tables, spirals and diaphragm jigs. The separation efficiency of this equipment is typically quite low; e.g. recovery of diamond indicators can be as low as 80% in diamond exploration samples. The concentrate from the separation often contains a considerable amount of waste material, and further downstream separation process is required to remove this material which is undesirable.

With preferred embodiments of the applicant's cyclone, a sharp separation can usually be achieved when treating fine mineral samples, 2 mm to 0.1 mm in size. Recovery of heavy minerals may be 95% or greater, rejecting 85% of waste materials to the overflow in a one-stage separation. Applicant is therefore hopeful that preferred forms of its cyclone will be used in place of traditional gravity concentrators.

Current mineral beneficiation plant configurations often include a first flotation step, a second gravity concentrator step, and a third cyclone separation step.

Applicant is hopeful that with improved cyclone efficiency particularly in treating small particles the gravity concentration step can be eliminated. This will reduce the process to a flotation step and a cyclone separation step considerably streamlining the process and the capital cost of the plant. It will also eliminate the inefficiencies associated with the use of gravity concentrators.

It will of course be realised that the above has been given only by way of illustrative example of the invention and that all such modifications and variations thereto as would be apparent to persons skilled in the art are deemed to fall within the broad scope and ambit of the invention as herein set forth.

What is claimed is:

1. A cyclone for effecting a separation on a fluid stream containing entrained particles, the cyclone including:

a body having a circumferential side wall extending between upper and lower ends and defining an interior space, the side wall comprising an upper wall portion and adjacent lower wall portion tapering inwardly in a direction away from the upper wall portion, the upper wall portion defining an inlet for introducing fluid and entrained particles into the interior space and the lower wall portion defining an underflow outlet extending in the direction of the longitudinal axis of the body for removing some fluid and entrained particles; and a vortex finder projecting substantially axially into the interior space through the upper end of the body and terminating at an internal end positioned below the inlet, the vortex finder defining an overflow outlet which removes the remaining fluid and entrained particles from the cyclone;

wherein the vortex finder and the upper wall portion are configured to define a feed zone of decreasing cross sectional area from the inlet to the internal end of the vortex finder.

2. A cyclone according to claim 1, wherein the vortex finder defines an outer wall surface that tapers outwardly from the inlet to the internal end of the vortex finder.

3. A cyclone according to claim 2, wherein the outer wall surface of the vortex finder tapers outwardly from the upper end of the body to the internal end of the vortex finder.

4. A cyclone according to claim 3, wherein the vortex finder tapers outwardly at an angle of 83° to 88° relative to an axis extending orthogonally to the longitudinal axis of the body.

5. A cyclone according to claim 4, wherein the ratio of the diameter of the outer wall of the vortex finder at the internal end of the vortex finder to the diameter of the aligned upper wall portion of the body is 0.65 to 0.85.

6. A cyclone according to claim 2, wherein the diameter of the outlet defined in the vortex finder is less than one half of the diameter of the outer wall surface of the vortex finder at the internal end of the vortex finder.

7. A cyclone according to claim 1, wherein the thickness of the outer wall of the vortex finder is 17%–23% of the diameter of the body of the cyclone at a position aligned with the internal end of the vortex finder.

8. A cyclone according to claim 1, wherein the upper wall portion tapers radially inwardly in a longitudinal direction away from the inlet.

9. A cyclone according to claim 8, wherein the upper wall portion tapers inwardly at an angle of 3° to 10° relative to the longitudinal axis of the body.

10. A cyclone according to claim 1, wherein the lower wall portion tapers inwardly away from the upper wall portion at an angle of 4° to 10° relative to the longitudinal axis of the body for fine particle separation.

11. A cyclone according to claim 1, wherein the lower wall portion defines a formation projecting inwardly into the interior space of the body substantially transverse to the longitudinal axis of the body.

12. A cyclone according to claim 11, wherein the formation is a shoulder extending substantially fully around the circumference of the lower wall portion.

13. A cyclone according to claim 12, wherein the shoulder has a depth of 1 mm to 5 mm or the shoulder has a depth of 3% to 6% of the diameter of the underflow outlet.

14. A cyclone according to claim 13, wherein the lower wall portion forms a spigot adjacent the lower end of the body and the shoulder is formed proximate the spigot.

15. A cyclone for effecting a separation on a fluid stream containing entrained particles, the cyclone including a body having a circumferential side wall extending between upper and lower ends and defining an interior space, the side wall comprising an upper wall portion and adjacent lower wall portion tapering inwardly in a direction away from the upper wall portion, the upper wall portion defining an inlet for introducing fluid and entrained particles into the interior space and the lower wall portion defining an underflow outlet extending in the direction of the longitudinal axis of the body for removing some fluid and entrained particles; and a vortex finder projecting substantially axially into the interior space through the upper end of the body and terminating at an internal end positioned below the inlet, the vortex finder defining an overflow outlet which removes the remaining fluid and entrained particles from the cyclone;

wherein the vortex finder flares outwardly from the upper end of the body to its internal end and occupies at least 40% of the cross sectional area of the body of the cyclone at a position aligned with the internal end of the vortex finder.

16. A cyclone according to claim 15, wherein the vortex finder occupies between 40% and 60% of the cross sectional area of the body of the cyclone at a position aligned with the internal end of the vortex finder.

17. A cyclone according to claim 16, wherein the vortex finder occupies between 40% and 55% of the cross sectional area of the body of the cyclone at a position aligned with the internal end of the vortex finder.

18. A cyclone for effecting a separation on a fluid stream containing entrained particles, the cyclone including a body having a circumferential side wall extending between upper and lower ends and defining an interior space, the side wall comprising an upper wall portion and adjacent lower wall portion tapering inwardly in a direction away from the upper wall portion, the upper wall portion defining an inlet for introducing fluid and entrained particles into the interior space and the lower wall portion defining an underflow outlet extending in the direction of the longitudinal axis of the body for removing some fluid and entrained particles; and a vortex finder projecting substantially axially into the interior space through the upper end of the body and terminating at an internal end positioned below the inlet, the vortex finder defining an overflow outlet which removes the remaining fluid and entrained particles from the cyclone;

wherein the lower wall portion includes a formation extending radially inwardly into the interior space substantially perpendicular to the longitudinal axis.

19. A cyclone according to claim 18, wherein the formation is a shoulder extending substantially fully around the circumference of the lower wall portion, and the shoulder is positioned adjacent to the underflow outlet.

20. A cyclone according to claim 19, wherein the shoulder has a depth of 1 mm to 5 mm.

21. A cyclone for effecting a separation on a fluid stream containing entrained particles, the cyclone including a body having a circumferential side wall extending between upper and lower ends and defining an interior space, the side wall comprising an upper wall portion and adjacent lower wall portion tapering inwardly in a direction away from the upper wall portion, the upper wall portion defining an inlet for introducing fluid and entrained particles into the interior space and the lower wall portion defining an underflow outlet extending in the direction of the longitudinal axis of the body for removing some fluid and entrained particles; and a vortex finder projecting substantially axially into the interior space through the upper end of the body and terminating at an internal end positioned below the inlet, the vortex finder defining an overflow outlet which removes the remaining fluid and entrained particles from the cyclone;

wherein the vortex finder defines an outer wall surface which tapers outwardly from the upper end of the body towards its internal end and the upper wall portion also tapers radially inwardly in a longitudinal direction from the inlet towards the lower wall portion.

22. A cyclone according to claim 21, wherein the outer wall surface of the vortex finder tapers outwardly at an angle of 83° to 88° to an axis extending perpendicularly to the longitudinal axis through the body of the cyclone.

23. A dense media cyclone for effecting a separation on a fluid stream containing entrained particles of varying gravities, the dense media cyclone including: a body having a circumferential side wall extending between upper and lower ends and defining an interior space, and a longitudinal axis extending through the upper and lower ends, the side wall comprising an upper wall portion tapering inwardly at an angle of from about 3°–to about 10° relative to the longitudinal axis, and an adjacent lower wall portion tapering inwardly at an angle of from about 4°–to about 10° relative to the longitudinal axis, the upper wall portion defining an inlet for introducing fluid and entrained particles into the interior space and the lower wall portion defining an underflow outlet extending in the direction of the longitudinal axis of the body for removing some fluid and entrained particles, and a vortex finder projecting substantially axially into the interior space through the upper end of the body and terminating at an internal end positioned below the inlet, the vortex finder defining an overflow outlet through which the remaining fluid and entrained particles exit the cyclone, and the vortex finder tapering outwardly towards its internal end at an angle of from about 83° to about 87° relative to an axis extending orthogonally to the longitudinal axis, and wherein the lower wall portion defines an inwardly extending shoulder extending substantially fully around the circumference of the lower wall portion.

24. A classification cyclone for effecting a separation on a fluid stream containing entrained particles of varying sizes, the classification cyclone including: a body having a circumferential side wall extending between upper and lower ends and defining an interior space, and a longitudinal axis extending through the upper and lower ends, the side wall comprising an upper wall portion tapering inwardly at an angle of from about 3°–to about 10° relative to the longitudinal axis, and an adjacent lower wall portion tapering inwardly at an angle of from about 4°–to about 10° relative to the longitudinal axis, the upper wall portion defining an inlet for introducing fluid and entrained particles into the interior space and the lower wall portion defining an underflow outlet extending in the direction of the longitudinal axis of the body for removing some fluid and entrained particles, and a vortex finder projecting substantially axially into the interior space through the upper end of the body and terminating at an internal end positioned below the inlet, the vortex finder defining an overflow outlet through which the remaining fluid and entrained particles exit the cyclone, and the vortex finder tapering outwardly toward its internal end at an angle of from about 84° to about 88° relative to an axis extending orthogonally to the longitudinal axis, and wherein the lower wall portion defines an inwardly extending shoulder extending substantially fully around the circumference of the lower wall portion.

* * * * *